US008598790B2

(12) United States Patent
Abs

(10) Patent No.: US 8,598,790 B2
(45) Date of Patent: Dec. 3, 2013

(54) ELECTRON ACCELERATOR HAVING A COAXIAL CAVITY

(75) Inventor: Michel Abs, Bossiere (BE)

(73) Assignee: Ion Beam Applications, S.A., Louvain-la-Neuve ( * ) Notice: Subject to any disclaimer, the term of this patent is extended or adjusted under 35 U.S.C. 154(b) by 102 days.

(21) Appl. No.: 13/441,221

(22) Filed: Apr. 6, 2012

(65) Prior Publication Data

US 2013/0093320 A1 Apr. 18, 2013

(30) Foreign Application Priority Data

Apr. 8, 2011 (EP) ..... 11161779

(51) Int. Cl.
*H01J 23/20* (2006.01)

(52) U.S. Cl.
USPC ..... 315/5.18; 315/5.41

(58) Field of Classification Search
None
See application file for complete search history.

(56) References Cited

U.S. PATENT DOCUMENTS

| | | | | |
|---|---|---|---|---|
| 3,916,246 | A * | 10/1975 | Preist | 315/5 |
| 4,763,079 | A * | 8/1988 | Neil | 315/500 |
| 5,107,221 | A * | 4/1992 | N'Guyen et al. | 315/500 |
| 5,363,053 | A * | 11/1994 | Etievant et al. | 315/506 |
| 5,376,893 | A * | 12/1994 | Etievant et al. | 315/501 |
| 5,440,211 | A * | 8/1995 | Jongen | 315/500 |
| 5,661,366 | A * | 8/1997 | Hirota et al. | 315/5.41 |
| 5,917,293 | A * | 6/1999 | Saito et al. | 315/505 |
| 6,433,494 | B1 * | 8/2002 | Kulish et al. | 315/500 |
| 7,994,739 | B2 * | 8/2011 | Chen | 315/504 |
| 8,169,167 | B2 * | 5/2012 | Bertozzi et al. | 315/507 |
| 8,362,717 | B2 * | 1/2013 | Chen | 315/504 |
| 2002/0079440 | A1 * | 6/2002 | Mills | 250/281 |
| 2009/0179599 | A1 * | 7/2009 | Bertozzi et al. | 315/507 |
| 2010/0148705 | A1 * | 6/2010 | Chen | 315/507 |
| 2010/0150312 | A1 * | 6/2010 | Chen | 378/121 |

FOREIGN PATENT DOCUMENTS

| | | | |
|---|---|---|---|
| WO | 88/09597 | A1 | 12/1988 |
| WO | 92/22190 | A1 | 12/1992 |
| WO | 2008138998 | A1 | 11/2008 |

* cited by examiner

*Primary Examiner* — Crystal L Hammond
(74) *Attorney, Agent, or Firm* — Christopher Casieri

(57) ABSTRACT

Electron accelerator of the re-circulating type, having a resonant coaxial cavity presenting an outer cylindrical conductor of axis A and a coaxial inner cylindrical conductor, an electron gun for injecting electrons into the cavity following a radial direction and into a median plane of the cavity, an RF system capable of accelerating the injected electrons following a trajectory into the median plane which has the shape of a flower centered on the axis A, deflecting magnets disposed into the median plane externally to the cavity for redirecting electrons back towards the axis A. The RF system includes final power amplifiers, each amplifier being directly coupled to the cavity through its own individual inductive loop and each two of these loops being physically spaced apart from each other by an angle alpha, such that alpha is not an integer multiple of 90 degrees.

6 Claims, 5 Drawing Sheets

ELECTRON ACCELERATOR HAVING A COAXIAL CAVITY

CROSS REFERENCE TO RELATED APPLICATIONS

Figure 1B:
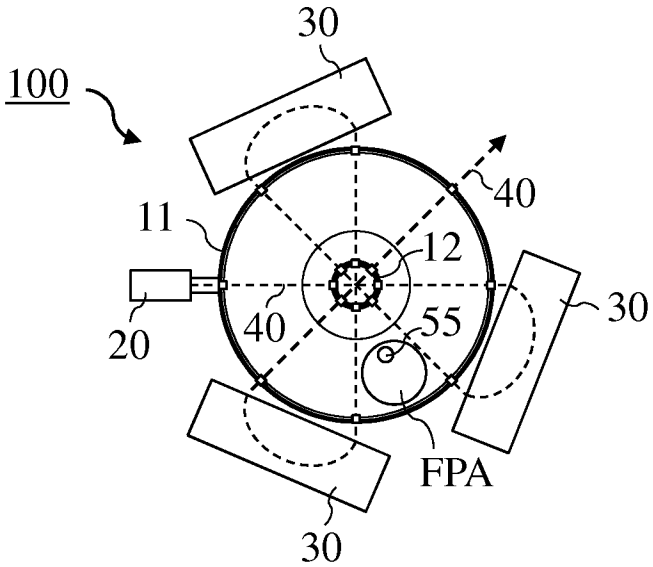

This application claims priority of European Patent Application No. 11161779.1 filed on Apr. 8, 2011.

FIELD OF THE INVENTION

The invention relates to an electron accelerator of the recirculating type and sometimes referred to as a Rhodotron® because the trajectory followed by the electrons in the accelerator has the shape of a flower ("Rhodos" means flower in Greek).

The invention more particularly relates to an electron accelerator comprising:

- a resonant cavity having an outer cylindrical conductor of axis A and a coaxial inner cylindrical conductor, both cylindrical conductors being shorted at their ends with respectively a top conductive closure and a bottom conductive closure,
- an electron gun adapted to inject a beam of electrons into the resonant cavity following a radial direction in a median transversal plane of the resonant cavity,
- an RF system adapted to generate a resonant transverse electric field into the resonant cavity for accelerating the electrons of the electron beam a plurality of times into the median transversal plane and according to successive trajectories following angularly shifted diameters of the outer cylindrical conductor, said RF system (50) comprising a plurality of final power amplifiers (FPA1, FPA2, . . . , FPAn), each final power amplifier being separately coupled to the cavity (10) through an individual inductive loop (55), and
- deflecting magnets for bending back the electron beam emerging from the outer cylindrical conductor and for redirecting the beam towards the axis A.

DESCRIPTION OF PRIOR ART

Such accelerators are known from European patent number EP-359774 and from European patent number EP-694247.

The resonant cavity of these known electron accelerators is energized by a high-frequency high-power RF source (hereafter the RF system) operating in the VHF frequency range, generally around 100 MHz or around 200 MHz, and delivering an output RF power which can reach several hundreds of kilowatts.

Such known RF system typically comprises an oscillator for generating an RF signal at the desired frequency, followed by a chain of amplifiers for achieving the desired output RF power at the end of the chain. A final amplification stage in the chain comprises a final power amplifier (often referred to as an FPA) which is coupled to the resonant cavity so that the appropriate transverse electric field is generated inside the cavity.

A central component of such an FPA is typically a high-power high-frequency vacuum tube, such as a tetrode or a Diacrode® for instance. When in operation, this vacuum tube is submitted to very high thermal constraints and must be appropriately cooled down during operation. A failure in the cooling system for instance will quickly lead to a destruction of the tube by overheating, which would for instance lead to ceramics breakage. Furthermore, the high RF currents flowing across the tube electrodes may melt the socket contacts if those contacts are loose or damaged.

It goes without saying that the accelerator will be totally out of order if the vacuum tube of the FPA breaks down. This negatively affects users of the accelerator, all the more since replacing the vacuum tube of the FPA is a delicate and time-consuming task.

Such an accelerator is also known from international patent publication number WO2008/138998 which discloses a cavity equipped with two FPAs, each of which being separately coupled to the cavity through an individual inductive loop. Such a configuration may or may not work well, depending on parameters which are not disclosed in this document.

SUMMARY OF THE INVENTION

It is an object of the invention to provide an electron accelerator which is more reliable and/or more robust than the existing accelerators.

To this end, the electron accelerator according to the invention is characterised in that the individual inductive loops are physically spaced apart from each other by an angle alpha, such that alpha is not an integer multiple of 90 degrees.

The inventors have indeed found that, surprisingly, thanks to such a geometrical arrangement of the inductive loops, the cavity will be less prone to be excited according to unwanted resonance modes (i.e. modes which would not provide the electric field which is typically required for accelerating the electrons in the cavity according to the above mentioned flower-shaped trajectory), which would otherwise degrade the performance of the accelerator or even lead to no performance at all.

As an additional advantage of providing a plurality of FPAs (in particular: more than two FPAs), it becomes possible to provide a scalable accelerator. Indeed, an accelerator designed for delivering a maximum beam power can for example initially be equipped with one or two FPA delivering a fraction of the RF power needed for delivering the maximum beam power, and it can later be completed, without too much design change, with (an) additional FPA(s) for delivering increased beam power up to the maximum beam power.

In this context of costs, it is worthwhile to notice that the cost of the FPA represents an important part of the total cost of the accelerator. This is particularly true for very high power accelerators such as those requiring an RF power in the range of 1000 KW for instance. Vacuum tubes which are capable of delivering such high RF powers are very unique and hence very expensive. Now, by dividing this total RF power among a plurality of FPAs, it becomes possible to make use of lower power and more commonly available vacuum tubes, the cost of which, when multiplied by the number of FPAs needed for reaching a nominal power, being lower than that of a single high power tube of that nominal power. Hence a lower cost RF system can be obtained.

Preferably, the number of final power amplifiers is an odd number. The inventors have indeed found that the cavity will in such a case be even less prone to be excited according to unwanted resonance modes.

In a most preferred case, the number of final power amplifiers is equal to three and in their corresponding individual inductive loops are physically spaced apart from each other by an angle of 120 degrees.

SHORT DESCRIPTION OF THE DRAWINGS

Figure 1A:
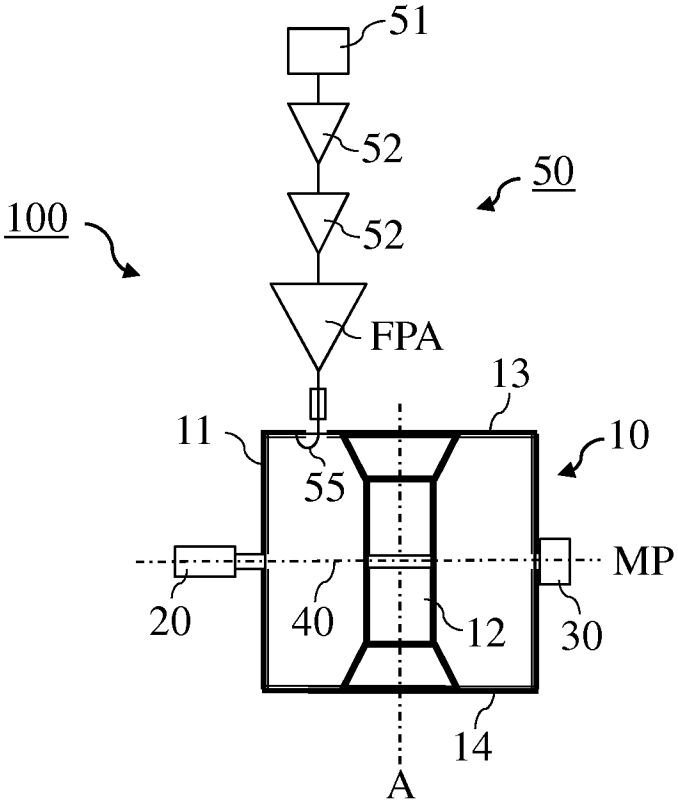
Figure 2B:
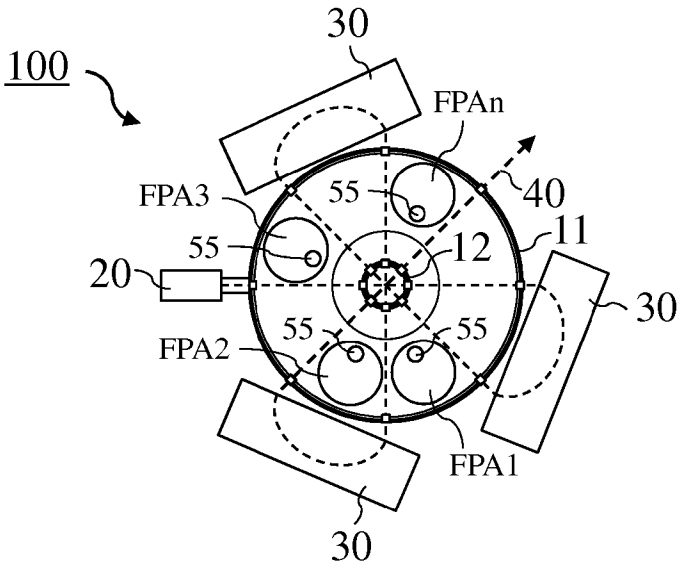
Figure 2A:
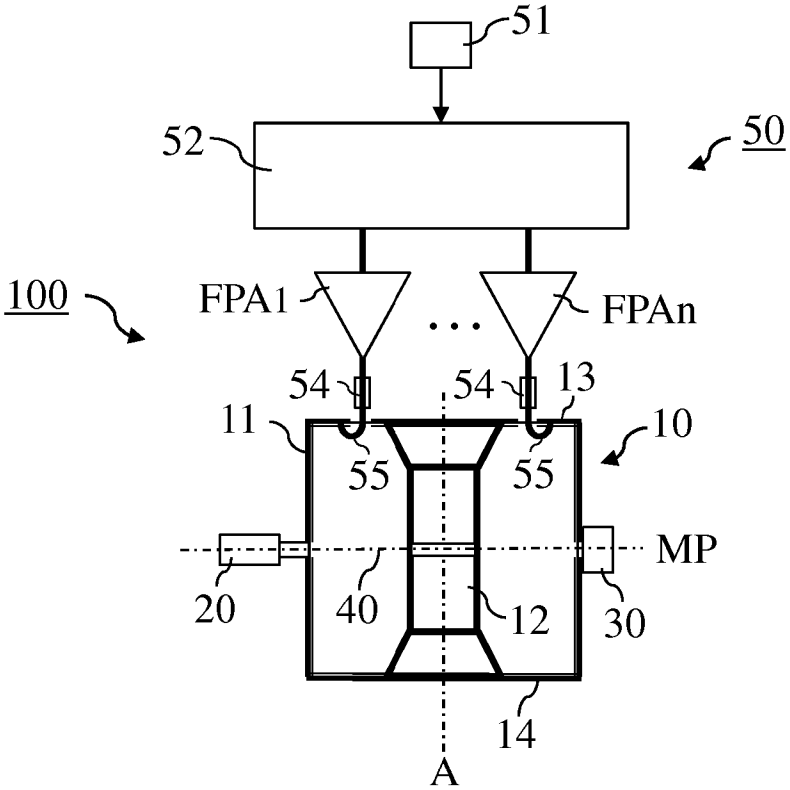
Figure 3:
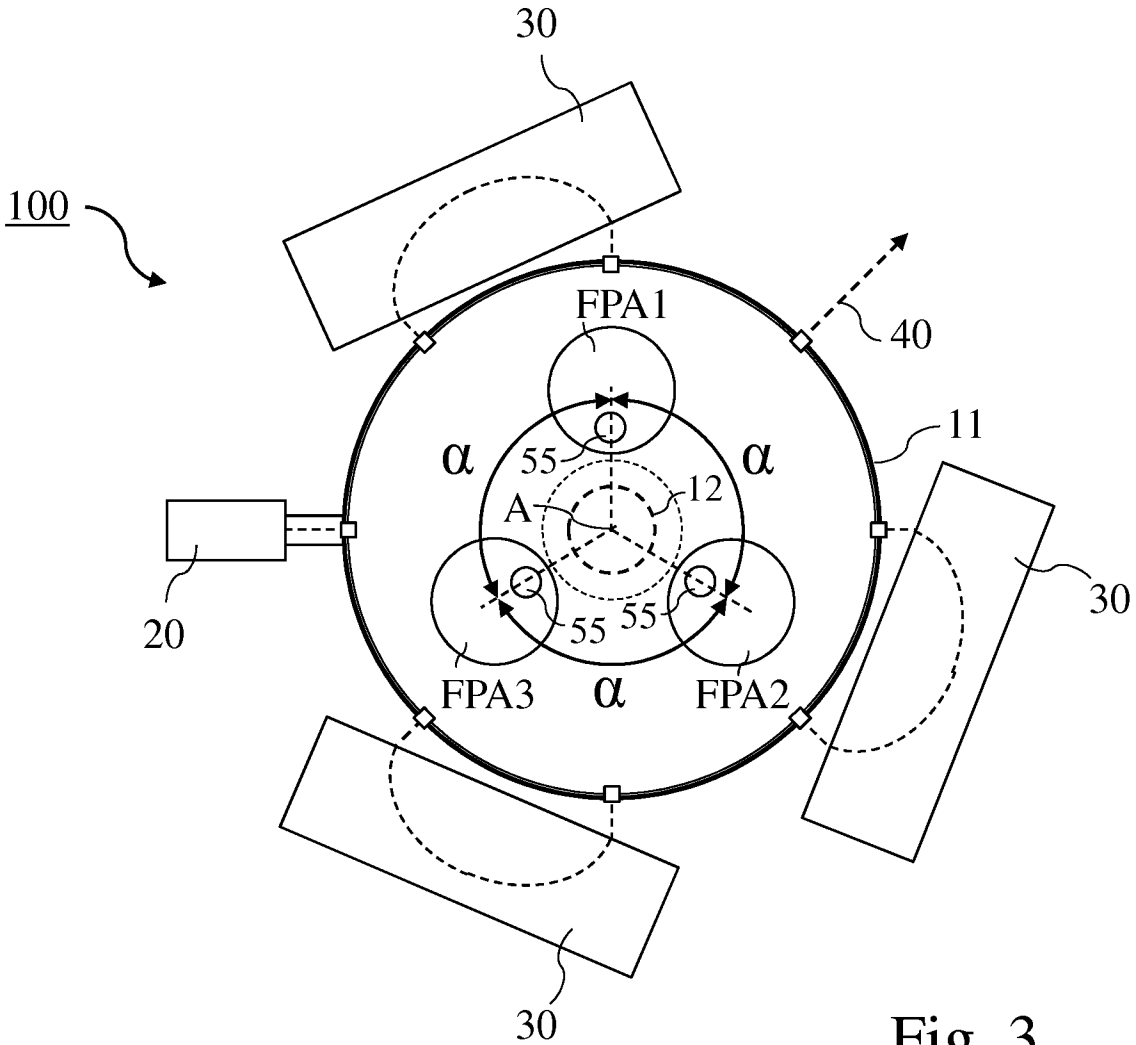
Figure 4:
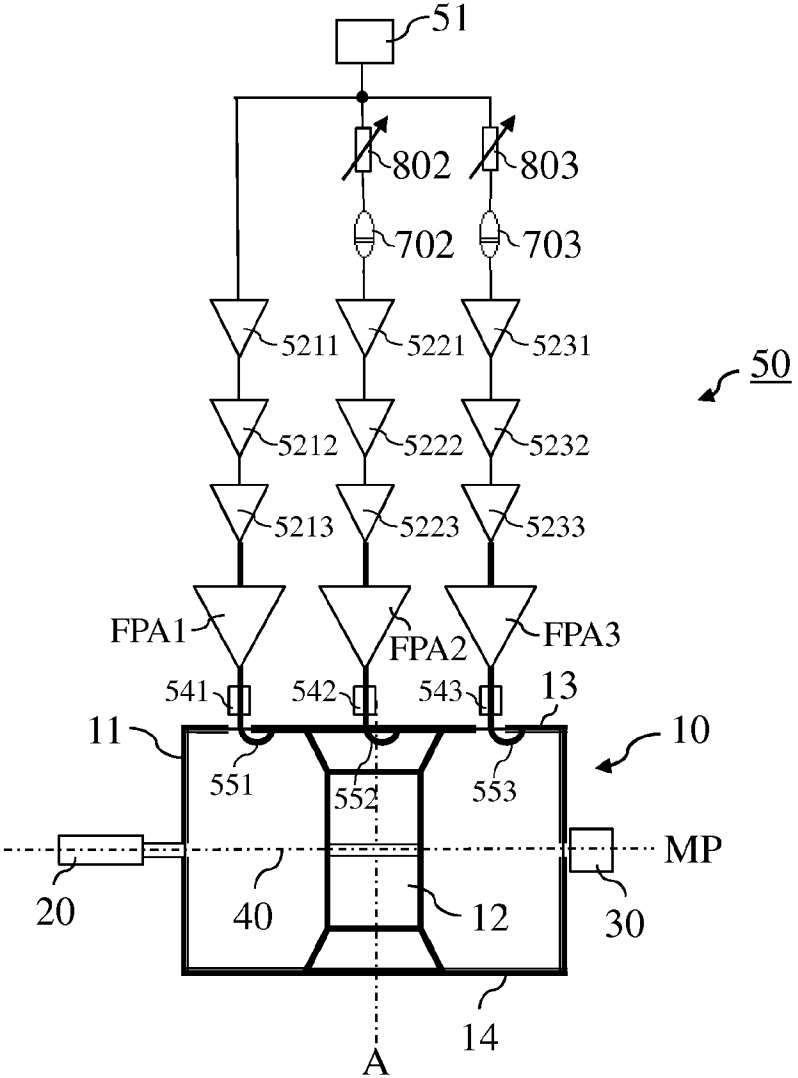

These and further aspects of the invention will be explained in greater detail by way of example and with reference to the accompanying drawings in which:

FIGS. 1*a* and 1*b* schematically show a prior art electron accelerator;

FIGS. 2*a* and 2*b* schematically show an electron accelerator according to the invention;

FIG. 3 schematically shows a top view of an electron accelerator according to a preferred version of the invention;

FIG. 4 schematically shows an electron accelerator according to a more preferred version of the invention.

Figure 5:
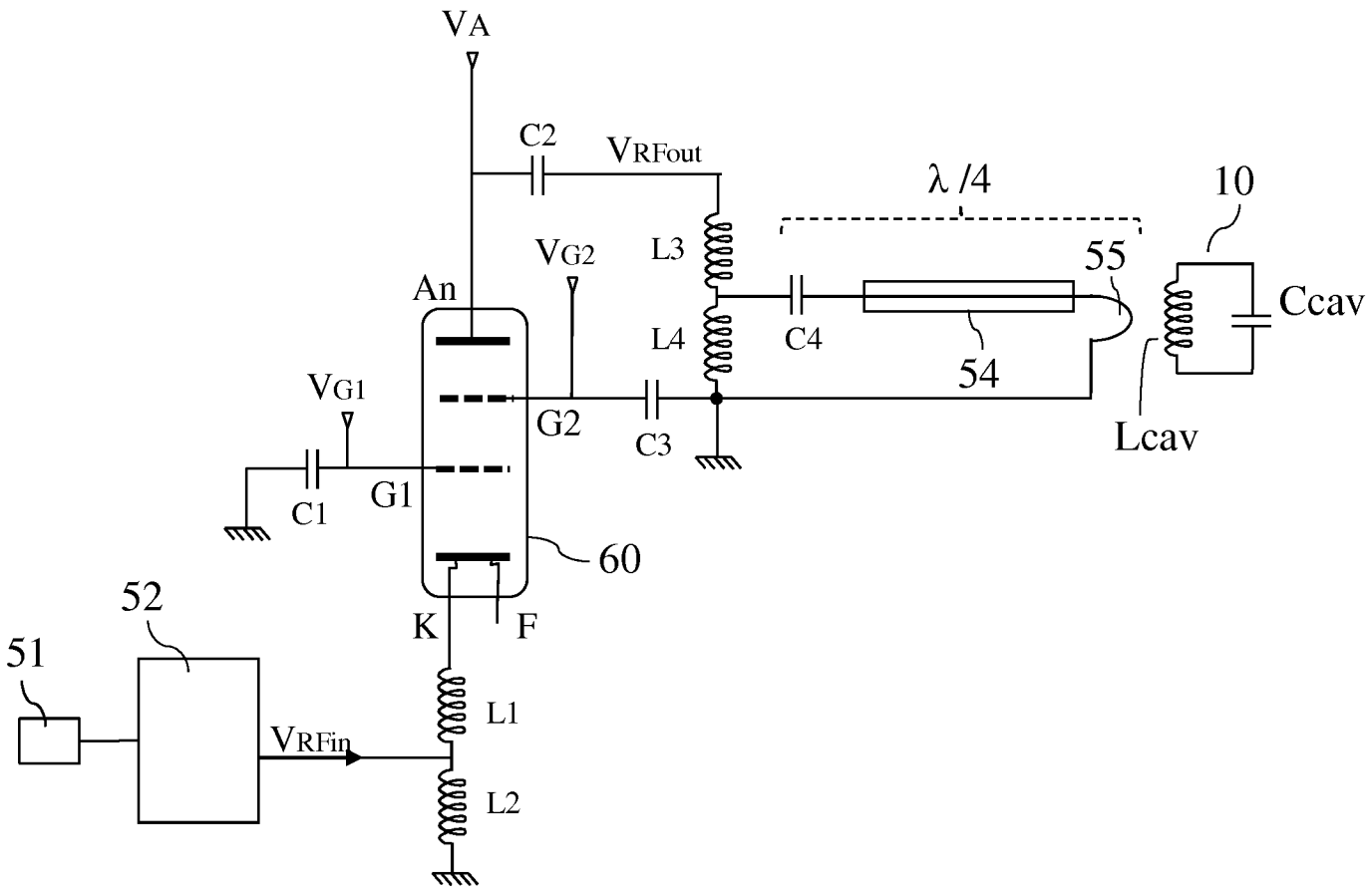

FIG. 5 schematically shows an exemplary final power amplifier and how it is coupled to a resonant cavity of an electron accelerator according to the invention;

The figures are not drawn to scale. Generally, identical components are denoted by the same reference numerals in the figures.

DETAILED DESCRIPTION OF PREFERRED EMBODIMENTS

FIG. 1*a* schematically shows a prior art electron accelerator. It comprises a resonant cavity (10) having an outer cylindrical conductor (11) of axis (A) and an inner cylindrical conductor (12) having the same axis (A), both cylindrical conductors being shorted at their ends with respectively a top conductive closure (13) and a bottom conductive closure (14). It furthermore comprises an electron gun (20) which is adapted to inject a beam of electrons into the resonant cavity (10) following a radial direction in a median transversal plane (MP) of the resonant cavity (10), and an RF system (50) adapted to generate a resonant transverse electric field of the "TE001" type into the resonant cavity (10) for accelerating the electrons of the electron beam (40) a plurality of times into the median transversal plane (MP) and according to successive trajectories following angularly shifted diameters of the outer cylindrical conductor (11). Conventionally, the "TE001" mode means that the electric field is transverse ("TE"), that said field has a symmetry of revolution (first "0"), that said field is not cancelled out along one radius of the cavity (10) (second "0"), and that there is a half-cycle of said field in a direction parallel to the axis A of the cavity (10).

FIG. 1*b* schematically shows a cross section of the accelerator of FIG. 1*a*, on which the trajectory of the electron beam (40)—indicated by a dotted line—can be more clearly seen (flower shape).

The accelerator also comprises deflecting magnets (30) for bending back the electron beam (40) emerging from the outer cylindrical conductor (11) and for redirecting the beam towards the axis A.

The RF system (50) of such a known accelerator typically comprises an oscillator for generating an RF signal at the desired frequency, followed by a chain of amplifiers for achieving the desired output power at the end of the chain. A final amplification stage in the chain comprises a final power amplifier (FPA) which is coupled to the resonant cavity (10) for energizing the cavity (10) so that the appropriate transverse electric field is generated in the cavity (10) when the RF system (50) is put into operation.

Such an accelerator is well known in the art, for example from European patent number EP-0359774 and from American U.S. Pat. No. 5,107,221, and it will therefore not be described in further detail here.

FIG. 2*a* schematically shows an electron accelerator (100) according to the invention. Except for the RF system (50), the structure and operation of this accelerator (100) is similar to that of FIGS. 1*a* and 1*b*.

Of interest here is the RF system (50) of the accelerator. As with the known accelerators, the RF system (50) comprises an oscillator, such as a voltage controlled oscillator (VCO) for example, which generates a low power (a few Watts for instance) RF signal at the desired frequency, which is a resonance frequency of the cavity (10), for example at 107.5 MHz or at 215 MHz. This oscillator feeds a pre-amplifier stage (52) which is designed to amplify the low power RF signal up to a higher intermediate power.

According to the invention, the intermediate power RF signal is then fed to the inputs of a plurality of Final Power Amplifiers (FPA1, . . . , FPAn) for further increasing the power of the RF signal to a desired output RF power. As shown on FIG. 2*a*, the output of each FPA is separately coupled to the resonant cavity (10) through an individual transmission line (54) respectively terminated by an individual inductive loop (55). Each individual inductive loop (55) may for example pass through an individual opening made into the top conductive closure (13) of the cavity (10) and slightly protrude inside the top part (13) of the cavity (10), i.e. at a position in the cavity (10) where the electric field is at a minimum and where the magnetic field is at a maximum. When put into operation, each FPA will then generate a transverse electric field of the desired magnitude into the cavity (10) for accelerating the electrons (40) according to above described trajectory.

FIG. 2*b* schematically shows a top view of the accelerator (100) of FIG. 2*a* and from which one can see an exemplary spatial arrangement of the FPAs and of their respective inductive loops (55).

The following table gives a few examples of accelerator specifications in case the accelerator is equipped with a coaxial cavity (10) of 2 m diameter resonating at 107.5 MHz in the λ/2 mode and with an RF system (50) having various numbers of FPAs, each FPA yielding an output RF power of 280 KW:

| | One FPA | Two FPAs | Three FPAs | Four FPAs |
|---|---|---|---|---|
| $P_{rf}$(KW) | 280 | 560 | 840 | 1120 |
| $P_{cav}$ (KW) | 105 | 105 | 105 | 105 |
| $P_{beam}$ (KW) | 175 | 455 | 735 | 1015 |
| $I_{beam}$ (mA) | 25 | 65 | 105 | 145 |

Wherein:

$P_{rf}$ = total RF power as delivered by all FPAs $P_{cav}$ = total power consumed by the resonant cavity (10)

$P_{beam}$ = total beam power = $P_{rf} - P_{cav}$ $I_{beam}$ (mA) = beam current The individual inductive loops (55) are physically spaced apart from each other by an angle α (alpha) which is not an integer multiple of 90 degrees. In other words, the inductive loops (55) are neither spaced apart by 90 degrees, nor by 180 degrees, nor by 270 degrees.

Preferably, the number of final power amplifiers (FPA) is an odd number. More preferably, the number of final power amplifiers is equal to three.

Most preferably, the accelerator (100) comprises exactly three FPAs and their corresponding individual inductive loops (55) are physically spaced apart from each other by an angle of 120 degrees. FIG. 3 schematically shows a top view of an exemplary embodiment of such a preferred electron accelerator according to the invention. Accordingly, the top conductive closure (13) of the cavity (10) comprises respectively three openings with an angle of 120 degrees (with regard to the axis A) between any two openings and through which the respective loop conductors pass. Preferably, said openings and hence said inductive loops (55) are arranged on a circumference centered on the cavity axis A.

FIG. 4 schematically shows an electron accelerator (100) according to a more preferred version of the invention. Except for the RF system (50), this accelerator is similar to those described here above.

The RF system (50) is here equipped with a plurality of parallel amplification branches, in this example three branches comprising each a chain of three intermediate amplifiers (5211, 5212, 5123; 5221, 5222, 5223; 5231, 5232, 5233) and ending each with an FPA (FPA1, FPA2, FPA3) inductively coupled to the cavity (10) with their respective individual inductive loops (541, 542, 543) as explained here above. Each branch is fed with substantially the same RF signal originating from the oscillator (51).

Except for one branch (the left branch on the example of FIG. 4), each other branch (the middle and right branches on the example of FIG. 4), is furthermore equipped with a delay line (702, 703) for time-delaying the RF signal received from the oscillator (51). The amount of time delay introduced by each delay line is chosen so as to synchronize the transverse electric fields generated in the cavity (10) by each branch, i.e. so that these fields are substantially in phase with each other.

The selection of the appropriate time delays can be performed for example by first switching on the first FPA (the one without delay line and which is supposed to be a reference for the synchronization with the electron gun (20)), by then switching on a second FPA (one with a delay line) and by tuning its delay line (702) until the anode current of the second FPA's vacuum tube becomes minimum, and to repeat the previous step for all FPAs.

Preferably, a variable attenuator (802, 803) is placed upstream of each delay line (702, 703). In this manner, the corresponding FPAs (FPA2, FPA3) can be driven progressively. In the second step of the above synchronization method, the second FPA (FPA2) can then for example be switched on progressively, i.e. by first setting a maximum attenuation and by progressively reducing the attenuation. The same may hold for the third step of the method.

FIG. 5 schematically shows an exemplary final power amplifier (FPA) and how it can be coupled to a resonant cavity (10) in an accelerator according to the invention.

The FPA comprises a high power vacuum tube (60), in this case a tetrode (60) having an anode (An), a cathode (K), a control grid (G1) and a screen grid (G2). The cathode (K) receives the RF signal ($V_{RFin}$) from the pre-amplification stage (52) (L1 and L2 represent line impedances). The RF signal at the anode ($V_{RFout}$) is first DC-blocked through capacitor (C2) and then coupled to the resonant cavity (10), here represented by a parallel resonant LC circuit (Lcav, Ccav), through a $\lambda/4$ resonant inductive loop ($\lambda$ being the wavelength of the RF signal) made up of a capacitor (C4), a short transmission line (54) and an inductive loop (55) inside the cavity (10). Such kind of coupling provides for a substantially constant ratio between the transverse electric field in the cavity (10) and the RF voltage on the anode of the tetrode (60) ($V_{RFout}$). By this method, the load of the FPA shows up as variable resistance for the tetrode (60), so that it can operate at peak efficiency whatever the load.

The anode (An) furthermore receives a high DC voltage (VA) of 16 KV for instance. The control grid (G1) is polarized to a negative DC voltage VG1 of −300 V for instance, for operation of the FPA in the AB class. Capacitor C1 allows to put the control grid (G1) to the mass at the RF frequency. The screen grid (G2) is polarized to a positive DC voltage VG2 of +1000 V for instance. A part of the RF signal is fed back to the screen grid (G2) via capacitor C3. The cathode is directly heated by an additional power source (not shown).

In the figures, the power supplies for powering the various components of the RF system were not shown for clarity reasons. A single power supply with various power converters can be used for powering the various FPAs. Nevertheless, each final power amplifier (FPA1, FPA2, . . . ) of the RF system (50) is preferably provided with its own individual and independent power supply, so that the failure of one such power supply does not negatively affect the operation of the other FPAs.

The present invention has been described in terms of specific embodiments, which are illustrative of the invention and not to be construed as limiting. More generally, it will be appreciated by persons skilled in the art that the present invention is not limited by what has been particularly shown and/or described hereinabove. The invention resides in each and every novel characteristic feature and each and every combination of characteristic features. Reference numerals in the claims do not limit their protective scope. Use of the verbs "to comprise", "to include", "to be composed of", or any other variant, as well as their respective conjugations, does not exclude the presence of elements other than those stated.

Use of the article "a", "an" or "the" preceding an element does not exclude the presence of a plurality of such elements.

Summarized, the invention may also be described as follows: an electron accelerator (100) of the re-circulating type, sometimes also called a Rhodotron®, comprising a resonant coaxial cavity (10) presenting an outer cylindrical conductor (11) of axis A and a coaxial inner cylindrical conductor (12), an electron gun (20) for injecting electrons (40) into the cavity following a radial direction and into a median transversal plane (MP) of the cavity (10), an RF system (50) for generating a transverse electric field into the cavity which is capable of accelerating the injected electrons (40) following a trajectory into the median plane (MP) which has the shape of a flower centered on the axis A, deflecting magnets (30) disposed into the median plane (MP) externally to—and around the cavity (10) for redirecting electrons (40) emerging from the outer cylindrical conductor (11) back towards the axis A. The RF system comprises a plurality of final power amplifiers (FPA1, FPA2, . . . , FPAn), each said amplifier being directly coupled to the cavity (10) through its own individual inductive loop (55), and each two of these loops being physically spaced apart from each other by an angle alpha, such that alpha is not an integer multiple of 90 degrees so as to reduce the risk of the cavity being excited according to undesired modes.

Such electron accelerators may be used for the irradiation of various substances, such as agro-alimentary products, either directly by the accelerated electrons or indirectly by X-rays produced by said electrons after hitting a metal target for instance.

The invention claimed is:

1. Electron accelerator comprising a resonant cavity (10) having an outer cylindrical conductor (11) of axis A and a coaxial inner cylindrical conductor (12), both cylindrical conductors being shorted at their ends with respectively a top conductive closure (13) and a bottom conductive closure (14), an electron gun (20) adapted to inject a beam of electrons (40) into the resonant cavity (10) following a radial direction in a median transversal plane (MP) of the resonant cavity (10), an RF system (50) adapted to generate a resonant transverse electric field into the resonant cavity for accelerating the electrons of the electron beam (40) a plurality of times into the median transversal plane (MP) and according to successive trajectories following angularly shifted diameters of the outer cylindrical conductor (11), said RF system (50) comprising a plurality of final power amplifiers (FPAI, FPA2, . . . , FPAn), each final power amplifier being separately coupled to the cavity (i0) through an individual inductive loop (55), deflecting magnets (30) for bending back the electron beam (40) emerging from the outer cylindrical conductor (11) and for redirecting the beam (40) towards the axis A, wherein the individual inductive loops (55) are physically spaced apart from each other by an angle alpha, such that alpha is not an integer multiple of 90 degrees.

2. Electron accelerator according to claim 1, wherein the number of final power amplifiers is an odd number.

3. Electron accelerator according to claim 2, wherein the number of final power amplifiers is equal to three and wherein their corresponding individual inductive loops (55) are physically spaced apart from each other by an angle of 120 degrees.

4. Electron accelerator according to any of claims 1, 2 or 3, further comprising means (702, 703) for synchronizing the resonant transverse electric fields generated respectively by the plurality of final power amplifiers (FPAI, FPA2, . . . ) in the resonant cavity (10).

5. Electron accelerator according to any of claims 1, 2 or 3, wherein each final power amplifier (FPAI, FPA2, . . . ) comprises a cathode-driven tetrode (60) whose anode (An) is inductively coupled to the resonant cavity (10).

6. Electron accelerator according to any of claims 1, 2 or 3, wherein each final power amplifier (FPAI, FPA2, . . . ) has its own individual power supply.

* * * * *